United States Patent [19]

Yonkers et al.

[11] Patent Number: 4,823,430

[45] Date of Patent: Apr. 25, 1989

[54] VACUUM CLEANER WITH BRUSH LIFT-OFF

[75] Inventors: Robert A. Yonkers, Grandville; Henry J. Rosendall, Grand Rapids, both of Mich.

[73] Assignee: Amway Corporation, Ada, Mich.

[21] Appl. No.: 121,525

[22] Filed: Nov. 17, 1987

[51] Int. Cl.[4] ..... A41L 5/34

[52] U.S. Cl. ..... 15/361; 15/410

[58] Field of Search ..... 15/333, 361, 410

[56] References Cited

U.S. PATENT DOCUMENTS

| | | | |
|---|---|---|---|
| 2,024,260 | 12/1935 | White | 15/333 |
| 2,070,689 | 2/1937 | Smellie | 15/333 X |
| 2,103,101 | 12/1937 | Taylor | 15/333 |
| 2,300,204 | 10/1942 | Carlson . | |
| 2,389,877 | 11/1945 | Snyder . | |
| 2,606,337 | 8/1952 | Balluff | 15/337 |
| 2,644,976 | 7/1953 | Osborn | 15/333 |
| 2,653,343 | 9/1953 | Kunkler | 15/333 |
| 2,677,845 | 5/1954 | Daiger | 15/333 |
| 2,686,331 | 8/1954 | Humphrey | 15/333 |
| 2,730,752 | 1/1956 | Seck | 15/361 |
| 2,734,219 | 2/1956 | Kaufman | 15/333 X |
| 2,747,215 | 5/1956 | Segesman | 15/333 |
| 3,579,699 | 5/1971 | Balzer | 15/361 |
| 3,932,912 | 1/1976 | Johnson | 15/410 |
| 4,446,594 | 5/1984 | Watanabe et al. | 15/333 X |

FOREIGN PATENT DOCUMENTS

| | | | |
|---|---|---|---|
| 706144 | 3/1954 | United Kingdom | 15/333 |

*Primary Examiner*—Chris K. Moore

*Attorney, Agent, or Firm*—Price, Heneveld, Cooper, DeWitt & Litton

[57] ABSTRACT

An appliance provided with a base which has a working end and a handle structure provided with a lower barrel portion which is pivotally attached to the base. The barrel portion is provided with a pair of peripheral slots that cooperate with the pivotally mounted arms of a lift-off mechanism so that the working end of the appliance is selectively raised and lowered by the user pivoting the handle structure. An end of the barrel is provided with a pair of spaced-apart recesses which cooperate with the detent on a locking plate so that the handle structure may be locked into its storage position and provided with a maximum pivot limit in its operative range.

17 Claims, 4 Drawing Sheets

VACUUM CLEANER WITH BRUSH LIFT-OFF

BACKGROUND OF THE INVENTION

The present invention pertains to means for selectively raising working brushes of a cleaning appliance such as a vacuum cleaner, rug shampooer, floor polisher or the like. Vacuum cleaners are exemplary of such common floor cleaning appliances employed universally in home and business. The primary vacuum nozzle through which debris is passed typically includes a beater brush to aid in the removal of debris from a carpet. The beater brush is designed to rotate at a high speed so that its bristles engage and agitate the carpet fibers, and help pull the debris therein up into the primary vacuum nozzle. The cleaning of the carpet is generally accomplished by moving the vacuum cleaner along the floor surface until it has been thoroughly vacuumed.

There are times, however, when the vacuum cleaner continues to run, but is left stationary at one location on the carpet; such as when a user interrupts the vacuuming operation temporarily or is employing off-floor vacuuming accessories on nearby furniture or the like. If the primary vacuum nozzle with its beater brush is kept in its operative position in such a situation, the brush would tend to cause excessive wear on that location of the carpet. In an effort to obviate this problem, prior artisans have employed a variety of assemblies which operate to lift the primary vacuum nozzle with its beater brush up away from the carpet, so that the brush is allowed to rotate without engaging the carpet.

Numerous arrangements have been developed to facilitate the lifting of the primary vacuum nozzle. Some devices have employed foot pedals for selective actuation by the user; other devices are provided with mechanisms which are actuated by the attachment of vacuuming accessories; and still others are provided with means which are mechanically coupled to operate through movement of the vacuum cleaner's handle. However, these mechanisms require the user to perform affirmative additional steps to thereby raise the beater brush and/or employ complicated mechanical linkages to effect the lifting motion.

Further, any lift-off mechanism requires provisions that will lock it into its lifting position, so that the beater brush may be maintained above the floor surface. These locking arrangements are invariably, out of necessity, integrally tied to the manner in which the lift-off mechanism is actuated. Consequently, the locking arrangements typically incorporate the same deficiencies as previously cited; specifically, the usage of complicated linkages, additional affirmative user actions, or the attachment of accessory items. Hence, the need exists for a compact, efficient locking assembly that will not require additional user actions or be subject to disrepair due to multiplicity of parts.

Locking assemblies for locking handle structures in their storage positions are used extensively in the industry. These assemblies have taken on many forms. However, these are not of a compact, durable nature and/or are not tied in with the locking of the lift-off mechanism.

SUMMARY OF THE INVENTION

In the present invention, the brush raising operation is effected by a compact, efficient camming arrangement which is controlled and actuated by simply moving the appliance's handle to its storage position. A lift-off mechanism is pivotally mounted to the base of the appliance, and is provided with a lift-off roller which continually supports the appliance above the floor surface and rearwardly extending arm means which are biased into engagement with a cylindrical barrel portion of the appliance's handle structure. The barrel portion is provided with a cam slot, which cooperates with the arm means of the lift-off mechanism, to thereby pivotally move the lift-off mechanism as the barrel portion is rotated. The lift-off mechanism, in turn, operates to raise and lower the brush or like working end of the base into and out of engagement with the floor surface.

This construction provides a compact and efficient arrangement by which a beater brush is lifted from the floor when a vacuum cleaner is left in a stationary position. The lift-off mechanism is a fail-proof arrangement which does not require the user to perform any additional steps. The lift-off mechanism is actuated by merely rotating the vacuum cleaner's handle structure to its upright vertical storage position. The present invention obviates the need for complicated linkages to effectuate the necessary lifting motion. Due to its efficient construction, the mechanism is not only easily and economically made, but it is also very durable in that it is not subject to disrepair through use.

These and other objects, advantages and features of the present invention will be more fully understood and appreciated by references to the written specification and appended drawings.

DETAILED DESCRIPTION OF THE PREFERRED EMBODIMENT

Figure 1:
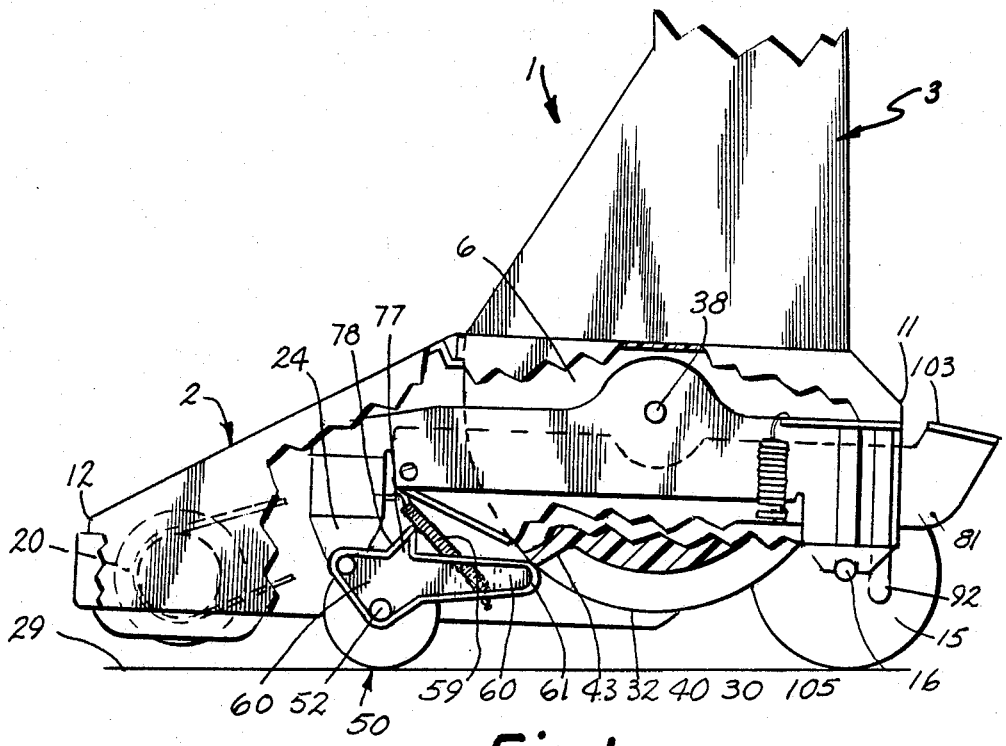
FIG. 1 is a side elevational, partially sectional view of the present invention with the handle structure in its storage position.
Figure 2:
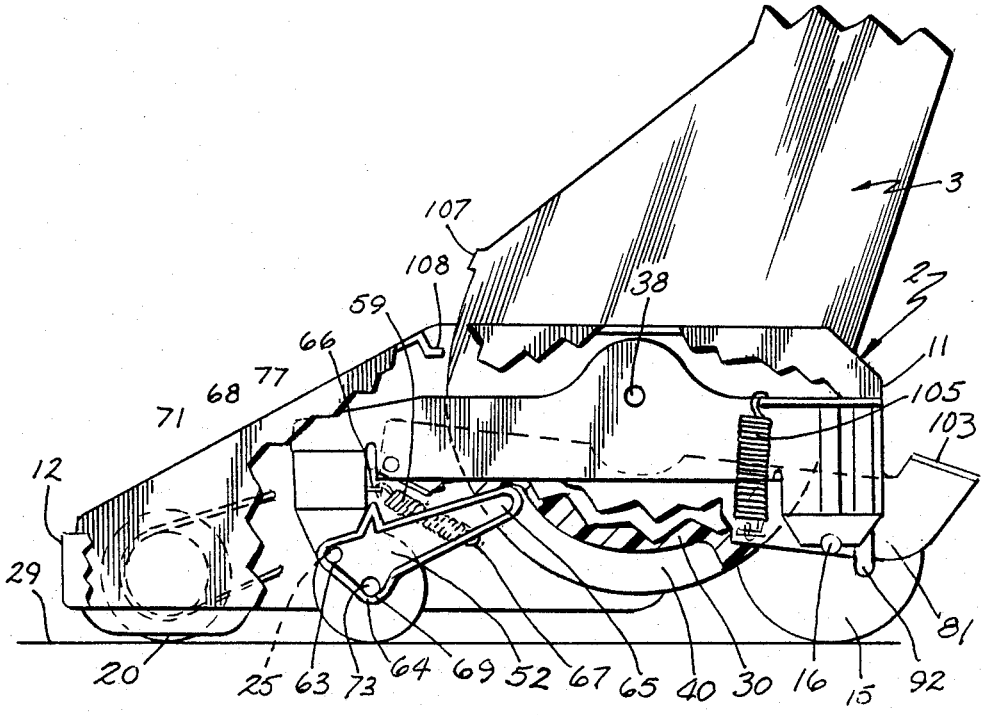
FIG. 2 is a side elevational view, partially in section, of the present invention with the handle structure in an operative position.
Figure 3:
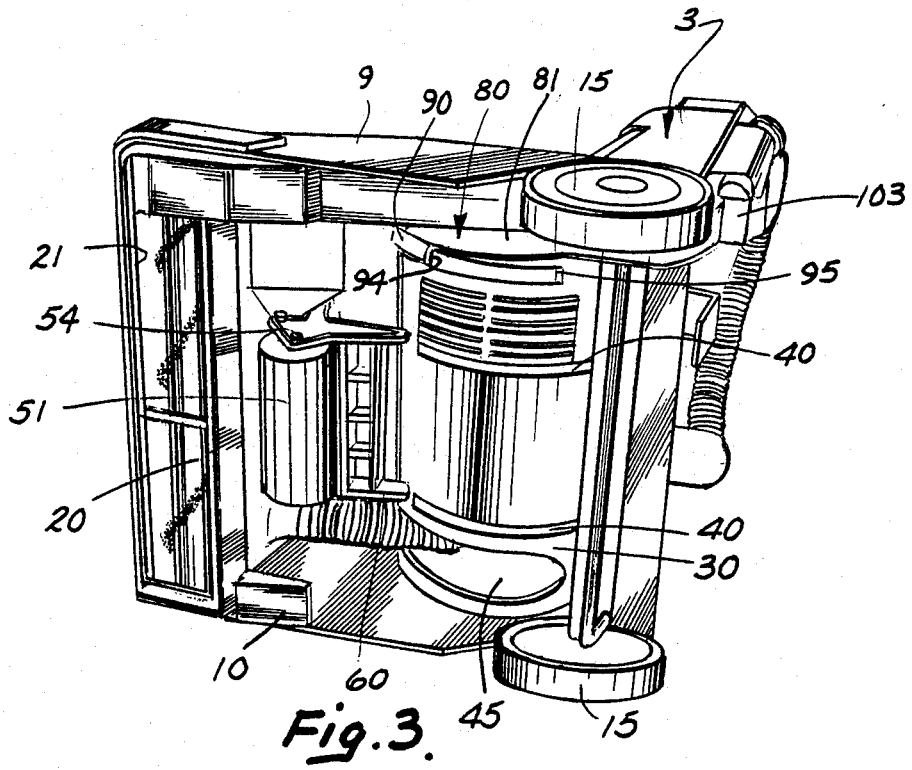
FIG. 3 is a perspective view of the bottom of the present invention with the handle structure in its storage position.
Figure 4:
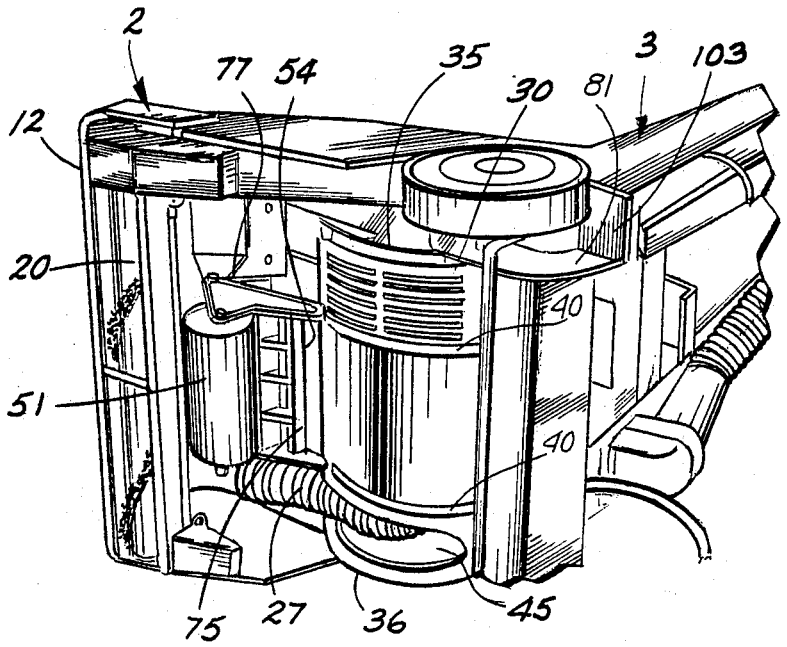
FIG. 4 is a perspective view of the bottom of the present invention with the locking assembly just released.
Figure 5:
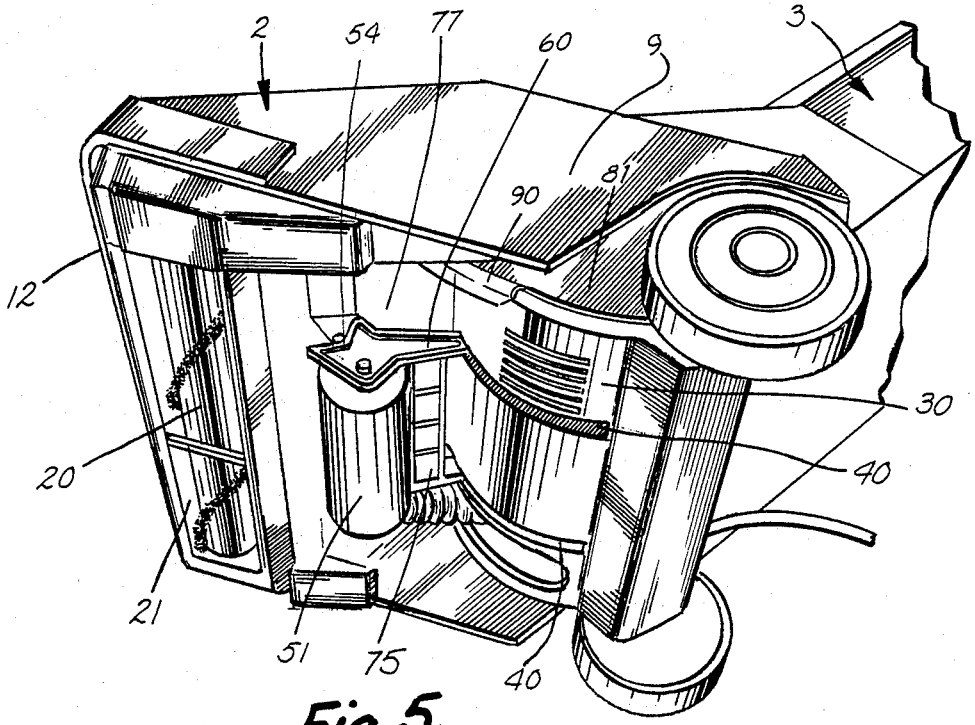
FIG. 5 is a perspective view of the bottom of the present invention with the handle structure in an operative position.
Figure 6:
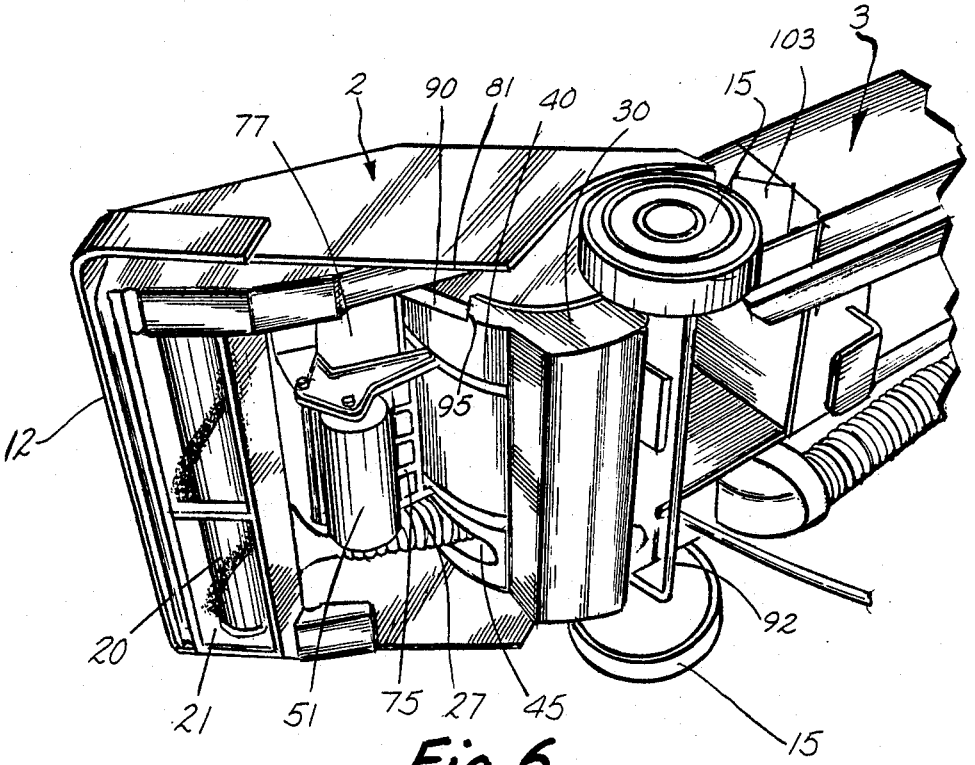
FIG. 6 is a perspective view of the bottom of the present invention with the handle structure at its maximum pivoted position away from its storage position.
Figure 7:
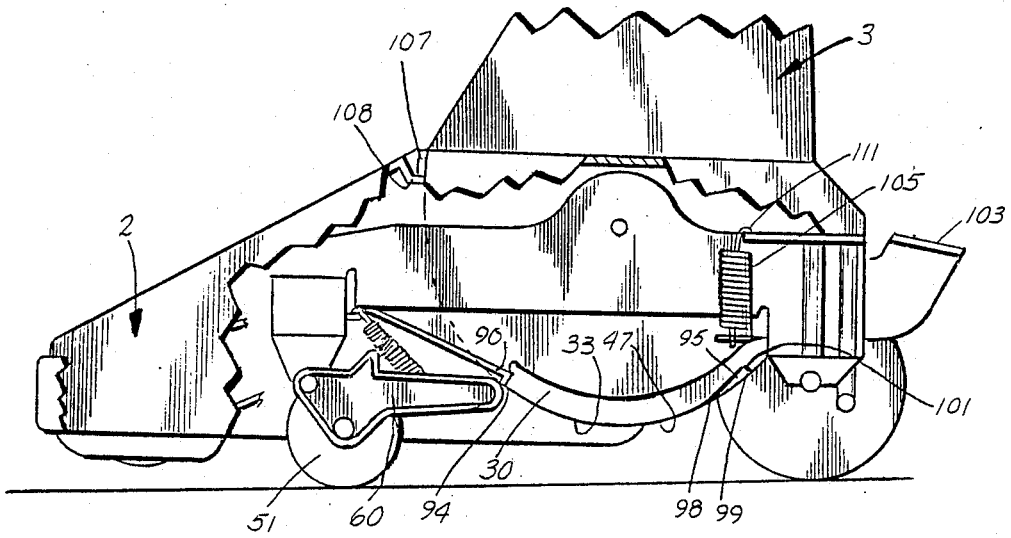
FIG. 7 is a partially broken away side view of the present invention with the handle structure in its storage position.

In the preferred embodiment, lift-off mechanism 50 is pivotally connected to vacuum cleaner base 2, and is provided with a lift-off roller 51 and a pair of free arms 60 (FIGS. 1–4). Free arms 60 are biased into engagement with a lower, cylindrical barrel portion 30 of upright handle structure 3 of vacuum cleaner 1. Barrel portion 30 is provided with slots 40 on a portion of its outer peripheral surface 32, which are aligned and adapted to receive arms 60. As arms 60 enter and exit slots 40, lift-off roller 51 is retracted and extended, respectively. The movement of lift-off roller 51, in turn, raises and lowers beater brush 20. Furthermore, as arms 60 exit slots 40 and handle structure 3 is pivoted upwardly, locking assembly 80 cooperates with a first end 35 of barrel 30 to lock handle structure 3 in its storage position (FIGS. 3 and 7). This is accomplished by providing locking assembly 80 with detent 90 which is received with a first recess 94 on barrel 30.

Vacuum cleaner 1 comprises base portion 2 and an upright handle structure 3 (FIG. 1). Base portion 2 is rollingly supported on floor 29 through the use of a three-part wheel assembly, which includes two rear wheels 15 and lift-off roller 51. Rear wheels 15 are positioned adjacent rearward end 11 and mounted to opposite sides 9, 10 of base 2 by axles 16, to thereby adequately support the rearward portion of vacuum cleaner 1. Forward end 12 of base 2 is movably supported by lift-off roller 51, as will be explained in more detail below. Cavity 21, adjacent forward end 12, rotatably receives therein beater brush 20. Beater brush 20 extends downwardly beyond base 2, so that it may engage the floor when vacuum cleaner 1 is in its operative position.

Extending above base 2 is handle structure 3 which is grasped by the user for moving and controlling vacuum cleaner 1. Handle structure 3 is pivotally mounted to base 2 about axis 38, to easily facilitate the to-and-fro motion which is generally utilized in vacuuming a floor surface. The pivotal mounting arrangement also permits handle structure 3 to be positioned in an upright, vertical storage position.

The lower end of handle structure 3 includes, integrally connected therewith, cylindrical barrel portion 30. Barrel portion 30 extends substantially across the width of base 2 and is positioned so that its longitudinal axis is aligned with pivotal axis 38. Barrel portion 30 includes first and second ends 35, 36 and a lower, arcuate, outer peripheral surface 32. Provided on peripheral surface 32 are a pair of parallel, spaced apart slots 40 (FIGS. 1–6). Slots 40 extend preferably about 80 degrees along barrel 30 to cooperate with lift-off mechanism 50 as will be explained below.

Lift-off mechanism 50 comprises a pivot arm assembly 54 which rotatably supports lift-off roller 51 on shaft 52 (FIGS. 1 and 2). Arm assembly 54 includes two spaced apart, parallel side arms 60 interconnected by a transverse framework 75. Framework 75 preferably is in the form of a lattice structure, but could be of any known construction. Each side arm 60 is somewhat triangular in shape and lies within a plane substantially parallel to barrel ends 35, 36.

First corners 63 of side arms 60 are directed toward forward end 12 of base 2 and are each positioned adjacent a bracket 24 extending downwardly from base 2. Each corner 63 is provided with a bore 68 which aligns with a complimentary bore 25 in a bracket 24, to receive therethrough pivot pin 71 which pivotally mounts arm assembly 54 to base 2.

Second corners 64 of arms 60, which extend generally downwardly and rearwardly of first corners 63, are also each provided with a bore 69 which receives therethrough shaft 73. Shaft 73 rotatably mounts lift-off roller 51, which is preferably a long cylindrical plastic roller member that extends across the distance between side arms 60; however, roller 51 may be of any known construction or material.

Distal ends 61 of arms 60 define third corners thereof. Arms 60 are aligned with slots 40 on barrel 30, and are adapted to be received therein when handle structure 3 is rotated to its operative position.

Arms 60 are biased into engagement with outer peripheral surface 32 of barrel portion 30 through the use of spring 59. Spring 59 is preferably a coil spring with one end 66 attached to base 2 and the other end 67 attached to frame work 75 of arm assembly 54. Of course, spring 59 could be in the form of a variety of different types of springs, such as a torsion spring. Spring 59 is designed to be in a constant state of expansion, so that arms 60 will always be in engagement with barrel portion 30.

When handle structure 3 is in its storage position, distal ends 61 of arms 60 are engaged on outer peripheral surface 32 of barrel portion 30 adjacent, but not received within, slots 40 (FIG. 1). In this position, lift-off mechanism 50 is pivoted downwardly, against spring 59, to raise forward end 12 of vacuum cleaner 1 so that beater brush 20 is out of engagement with floor surface 29.

When handle structure 3 is pivoted out of its storage position, into an operative position, barrel portion 30 also is rotated in a clockwise direction (as seen in FIG. 2). During the rotation of barrel portion 30, arms 60 encounter and are slid along cam surfaces 43 until received within slots 40. As arms 60 are moved along cam surfaces 43, lift-off mechanism 50 pivots counterclockwise around pivot pin 71 so that lift-off roller 51 is retracted toward base 2. Due to this retraction beater brush 20 is lowered into engagement with floor surface 29.

Note that lift-off roller 51 is designed to support forward end 12 of vacuum cleaner 1 at all times. Hence, it cannot be permitted to retract completely into base 2, otherwise beater brush 20 would be pressed into floor surface 29 and thereby foul the vacuuming procedure. To maintain roller 51 at a predetermined maximum retraction position, which will facilitate an efficient vacuuming operation, liftoff mechanism is provided with a pair of tabs 77. One tab 77 projects upwardly from each side arm 60 between first and third corners 63, 65 (FIGS. 1 and 2). Each tab 77 is provided with an abutting surface 78 which engages one of the brackets 24 to thereby limit the counterclockwise pivoting of lift-off mechanism 50 when arms 60 are received within slots 40. Hence, even though barrel 30 may continue to rotate as the user operates vacuum cleaner 1, lift-off mechanism 50 experiences no further pivoting once tabs 77 engage brackets 24. Tabs 77 abut brackets 24 during the initial pivoting of handle structure 3 from its storage position, and remain contiguous therewith generally throughout the vacuuming operation. This prevents the lift-off mechanism from pivoting during use and thereby causing vacuum cleaner 1 to rock a it is moved along floor surface 29.

As upright portion 3 is once again moved to its vertical storage position, arms 60 slide within slots 40 until they engage cam surfaces 43; whereupon arms 60 ride up out of slots 40. This movement pivots lift-off mechanism 50 clockwise (as seen in FIGS. 1 and 2) to once again extend roller 51 and lift beater brush 20 from floor surface 29.

Complimenting the pivoting action of handle structure 3 is locking assembly 80, which fulfills the dual purpose of locking handle structure 3 in its storage position, and limiting the range of pivoting permitted for handle structure 3. More specifically, locking assembly 80 comprises elongated locking plate 81, which is positioned adjacent a first end 35 of barrel portion 30 and lies substantially in a plane parallel thereto. Forward end 85 of locking plate 81 is pivotally mounted to base portion 2 of vacuum cleaner 1 by any conventional means, such as with a pin and bore arrangement. Rearward end 86 of locking plate 81 extends preferably between base 2 and strengthening rod 92, and beyond rearward end 11 of vacuum cleaner 1, to define foot pedal 103 in easy reach of the user. Along lower edge 88 of locking plate 81 is provided a transversely extending detent 90, which cooperates with barrel 30 in a manner as will be described below.

Figure 8:
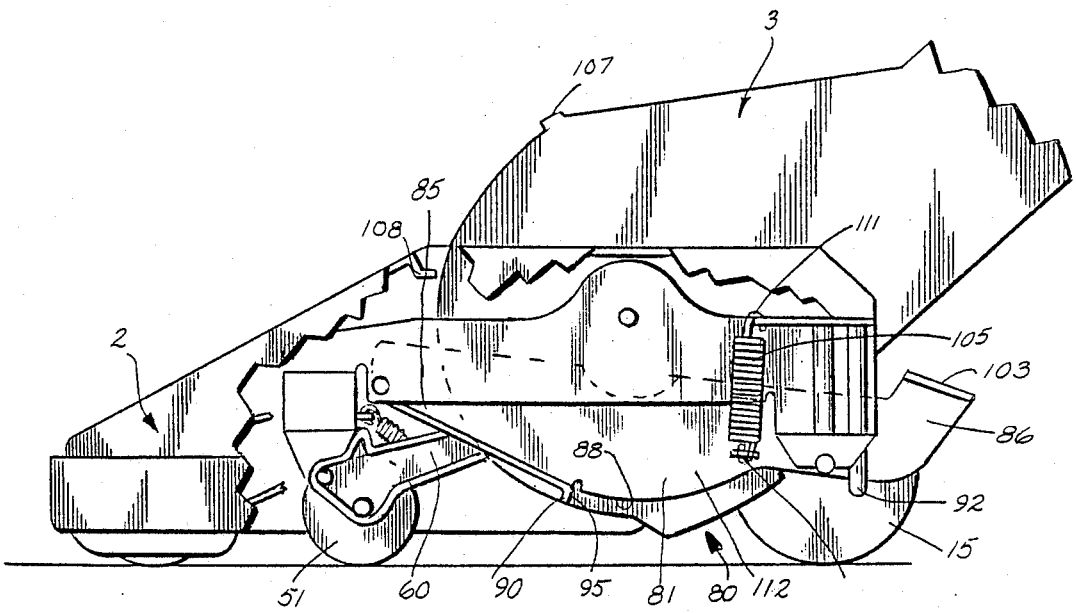
FIG. 8 is a partially broken away side view of the present invention with the handle structure in its maximum pivoted position away from its storage position.

First end 35 of barrel portion 30 is provided with a pair of recesses 94, 95 along its lower edge 47; that is, the edge defined by the intersection of outer peripheral surface 32 and first end 35 (FIGS. 7 and 8). Each recess 94, 95 is of the same shape, and defined by inclined ramp 97 and stop wall 101. Ramp 97 includes a first end 98 at outer peripheral surface 32 and a second end 99 positioned radially inwardly thereof. At second end 99, a stop wall 101 is provided which extends substantially radially from second end 99 to outer peripheral surface 32. Recesses 94, 95 are generally of a narrow construction and are adapted to receive therein detent 90 in locking relation; that is, detent 90 is selectively received within one of the recesses of 94, 95 in abutting relation with a stop wall 101. Note further, that locking plate 81 is biased upwardly by spring 105 to ensure that detent 90 will always engage outer peripheral surface 32 and therefore, be drawn up into recesses 94, 95 when barrel portion 30 is so rotated. Spring 105 is preferably a coil spring with a first end 111 attached to base 2 and a second end 112 attached to locking plate 81. Nevertheless, spring 105 could be in the form of any known adequate spring means.

First recess 94 is positioned on barrel portion 30 to engage detent 90 when handle structure 3 is placed in its vertical storage position. Since the engagement between stop wall 101 and detent 90 resists movement of barrel 30 in a clockwise direction (as seen in FIGS. 7 and 8), locking plate 81 prevents handle structure 3 from pivoting downwardly into an operative position. To unlock handle structure 3, so that it may be pivoted to its operative positions, the user pushes on foot pedal 103, against spring 105, to thereby disengage detent 90 from first recess 94. Hence, during operation of vacuum cleaner 1, detent 90 rides smoothly along between recesses 94, 95 on portion 33 of edge 47.

Second recess 95 functions as a maximum limit for the amount o clockwise pivoting permitted for handle structure 3 (as seen in FIG. 8). As handle structure 3 is pivoted downwardly barrel portion 30 rotates until detent 90 reaches second recess 95. Detent 90 then rides down ramp 97 until it abuttingly engages stop wall 101, to thereby prevent handle structure 3 from pivoting further downwardly. Note, that when detent 90 is received within second recess 95, that the vacuuming procedure need not be interrupted, or performed in a jerking motion. Ramp 97 easily permits the user to pivot handle structure 3 back upwardly once it has reached stop wall 101.

Referring again to first recess 94, it is likewise seen that, due to the provision of ramp 97, detent 90 will only prevent pivoting of handle structure 3 in a clockwise direction (as seen in FIGS. 7 and 8). In order to securely lock handle structure 3 in its storage position (that is, precluding movement in either direction) vacuum cleaner 1 further includes a pair of abutting flanges, 107, 108.

Abutting flanges 107, 108 abut one another when handle structure 3 is in its storage position, to thereby preclude further movement thereof in a counterclockwise direction (as seen in FIGS. 1, 2, 7 and 8). More specifically, first abutting flange 107 projects outwardly from handle structure 3 in a forward direction, at a point above slots 40, and a complimentary second abutting flange 108 projects from base portion 2 in a rearward direction. Abutting flanges 107, 108 are positioned, such that, as handle structure 3 is pivoted upwardly first abutting flange 107 moves downwardly toward second abutting flange 108, and engages it when handle structure 3 is in its storage position. Consequently, handle structure 3 is precluded from moving out of its storage position (FIGS. 1 and 7) via locking assembly 80 and abutting flanges 107, 108.

To further enhance the compact nature of the vacuum cleaner design, barrel portion 30 is also provided with a large opening 45 in its outer peripheral surface, near its second end 36. Opening 45 is adapted to receive therethrough vacuum hose 27 which fluidly connects cavity 21 with suction means 7. This arrangement not only permits vacuum cleaner 1 to be of a compact construction, but also tends to protect hose 27 from being damaged.

This unique design, facilitated by the handle structure's barrel portion 30, creates a compact, efficient arrangement. The lift-off mechanism, locking assembly and vacuum hose are all accommodated and interact in a durable, compact and efficient fashion with barrel portion 30, to make for a superior appliance.

The above description is considered to be that of the preferred embodiment only. Modifications of the invention will occur to those who make and use the invention. The true scope and spirit of the invention is to be determined by reference to the appended claims. It is desired to include within the scope of the invention all such modifications that come within the scope of the appended claims.

The embodiments of the invention in which an exclusive property or privilege is claimed are defined as follows:

1. An appliance comprising:

a base having a working end;

a handle structure pivotally connected to said base and including a barrel portion having an arcuate, peripheral surface, said barrel portion further including at least one slot on a predetermined portion of said peripheral surface; and a lift-off mechanism including an arm member pivotally attached to said base and a lift-off roller rotatably attached to said arm member and supporting said working end of said base at a variable height above a surface to be worked, said arm member being in engagement with said peripheral surface of said barrel portion such that said arm member is selectively received into and out of said at least one slot when said handle structure is pivoted, to thereby pivotally move said arm member and said lift-off roller attached thereto and thereby vary the height of said working end.

2. The appliance of claim 1 in which said handle structure is movable between a storage position and a range of operative positions, and wherein said arm member is positioned outside of said slot when said handle structure is in its storage position and is positioned within said slot when said handle structure is moved to an operative position, whereby said working end of said base is raised when said handle structure is in its storage position and is lowered when said handle structure is moved to an operative position.

3. The appliance of claim 2 in which said lift-off mechanism further includes a spring which biases said arm member toward said peripheral surface of said barrel portion, and in which said arm member further includes a tab adapted to engage said base to thereby limit the pivoting of said arm member toward said barrel portion, whereby the height of said working end during operation is set at a predetermined level.

4. The appliance of claim 3 in which said peripheral surface of said barrel portion is provided with a pair of spaced apart parallel slots, in which said lift-off mechanism further comprises a pair of spaced apart parallel arm members, wherein each arm member is aligned with one of said slots, and in which said lift-off roller is mounted between said arm members.

5. An appliance having a base with a working end and further comprising:

a handle structure pivotally connected to said base and including a barrel portion having an arcuate, peripheral surface and first and second ends, said barrel portion being provided with at least one slot on a predetermined portion of said peripheral surface and said first end being provided with a first recess;

a lift-off mechanism including a pivotally mounted arm member which rotatably supports a lift-off roller for supporting said working end of said base at a variable height above a surface to be worked, said arm member being in engagement with said peripheral surface of said barrel, whereby said arm member is selectably received into and out of said at least one slot to thereby pivot said arm member and change said height of said working end of said appliance when said handle structure is pivoted; and locking means for locking said barrel portion, said locking means including a pivotally mounted locking plate having a detent selectably receivable within said first recess, such that said first recess receives said detent to thereby lock said handle structure in a storage position.

6. The appliance of claim 5, in which said first end of said barrel portion further includes a second recess spaced from said first recess and adapted to receive said detent, whereby receipt of said detent in said second recess limits the extent to which said handle structure may be pivoted from the storage position.

7. The appliance of claim 6 in which said locking means further includes a spring which biases said locking plate into constant engagement with said barrel portion, whereby said detent will be biased into said first recess when said handle structure is pivoted to the storage position, and into said second recess when said handle structure is pivoted a predetermined distance away from the storage position.

8. The appliance of claim 7 in which each said recess includes a ramp with a first end which is at said outer peripheral surface of said barrel portion and a second end which is spaced radially inwardly from said outer peripheral surface, and a stop wall at said second end of said ramp which extends radially outwardly from said second end to said outer peripheral surface to thereby abuttingly engage said detent and preclude the handle structure from further pivoting in one direction when said detent is therein received.

9. The appliance of claim 8 further including first and second complimentary abutting flanges, wherein said first abutting flange projects outwardly from said handle structure in one direction and said second abutting flange projects outwardly from said base in an opposite direction, said abutting flanges are positioned so as to be in abutting engagement when said handle structure is moved to its storage position, whereby said handle structure is effectively locked into its storage position by said detent engaging said stop wall to thereby preclude pivoting of said handle structure in said one direction and by said first abutting flange engaging said second abutting flange to thereby preclude pivoting of the handle structure in an opposite direction.

10. The appliance of claim 7 wherein said locking plate further includes a foot pedal, whereby a user may easily disengage said detent from said recesses in order to facilitate pivoting of said handle structure.

11. An appliance having a base and further comprising:

a handle structure pivotally connected to said base and including a barrel portion having first and second ends, said first end having first and second recesses, and each said recess including a ramp and a stop wall;

a locking assembly including a pivotally mounted locking plate having a detent, said detent being adapted for selective receipt within said first recess when said handle structure is pivoted to a storage position and within said second recess when said handle structure is pivoted to a second position located a predetermined distance away from said storage position, whereby said locking assembly prevents said handle structure from pivoting in one direction when said detent is received within one of said recesses; and first and second abutting flanges, said first abutting flange being mounted to project from said handle structure and said second abutting flange being mounted to project from said base, whereby said abutting flanges engage and prevent said handle structure from pivoting in a direction opposite to said one direction when said handle structure is in the storage position.

12. The appliance of claim 11 in which said locking assembly further includes a spring which biases said detent into engagement with said barrel portion and into said recesses when aligned therewith, and a foot pedal whereby a user may easily disengage said detent from said recesses in order to facilitate pivoting of said handle structure in said one direction.

13. A vacuum cleaner comprising:

a base including a working end having a beater brush;

a handle structure pivotally connected to said base and including a barrel portion having an arcuate peripheral surface and first and second ends, said first end having a first recess, said barrel portion being further provided with at least one slot on a predetermined portion of said peripheral surface and an opening in said peripheral surface near said second end of said barrel to thereby receive therethrough a vacuum hose which fluidly connects said working end with a vacuum assembly in said handle structure;

a lift-off mechanism including a pivotally mounted arm member rotatably supporting a lift-off roller for supporting said working end of said base at a variable height above a surface to be cleaned, said arm member being in engagement with said peripheral surface of said barrel, whereby said arm member is selectively received into and out of said slot to thereby pivot said body and change the height of said working end of said appliance when said handle structure is pivoted; and a locking assembly including a pivotally mounted locking plate having a detent selectively receivable within said first recess such that said first recess receives said detent to thereby set said handle structure in a storage position.

14. The vacuum cleaner of claim 13 in which said handle structure is movable between a storage position and a range of operative positions, and wherein said arm member is positioned outside of said slot when said handle structure is in its storage position and is positioned within said slot when said handle structure is moved to an operative position, whereby said working end of said base is raised when said handle structure is in its storage position and is lowered when said handle structure is moved to an operative position.

15. The vacuum cleaner of claim 14 in which said lift-off mechanism further includes a spring which biases said arm member toward said peripheral surface of said barrel portion, and in which said arm member includes a tab adapted to engage said base to thereby limit the pivoting of said arm member toward said barrel portion whereby the height of said working end during operation is set at a predetermined level.

16. The vacuum cleaner of claim 13 in which said first end of said barrel portion further includes a second recess spaced from said first recess and adapted to receive said detent, whereby receipt of said detent in said second recess limits the extent to which said handle structure may be pivoted from the storage position.

17. The appliance of claim 13 further including first and second abutting flanges, said first abutting flange being mounted to project from said handle structure and said second abutting flange being mounted to project from said base, whereby said abutting flanges engage and prevent said handle structure from pivoting in a direction away from said operating positions when said handle structure is in the storage position.

* * * * *